US010283342B2

(12) United States Patent
Bezel et al.

(10) Patent No.: US 10,283,342 B2
(45) Date of Patent: May 7, 2019

(54) LASER SUSTAINED PLASMA LIGHT SOURCE WITH GRADED ABSORPTION FEATURES

(71) Applicant: KLA-Tencor Corporation, Milpitas, CA (US)

(72) Inventors: Ilya Bezel, Mountain View, CA (US); Anatoly Shchemelinin, Bozeman, MT (US); Kenneth P. Gross, San Carlos, CA (US); Matthew Panzer, San Jose, CA (US); Anant Chimmalgi, San Jose, CA (US); Lauren Wilson, San Jose, CA (US); Joshua Wittenberg, Fremont, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 15/360,397

(22) Filed: Nov. 23, 2016

(65) Prior Publication Data

US 2017/0164457 A1 Jun. 8, 2017

Related U.S. Application Data

(60) Provisional application No. 62/263,663, filed on Dec. 6, 2015.

(51) Int. Cl.
*H01J 61/02* (2006.01)
*H01J 61/04* (2006.01)
(Continued)

(52) U.S. Cl.
CPC ..... *H01J 61/025* (2013.01); *H01J 61/302* (2013.01); *H01J 61/52* (2013.01); *H01J 65/04* (2013.01)

(58) Field of Classification Search
CPC ..... H01J 61/025; H01J 61/302; H01J 61/52; H01J 61/04
See application file for complete search history.

(56) References Cited

U.S. PATENT DOCUMENTS 6,200,005 B1 * 3/2001 Roberts ..... H01J 61/025 313/113
7,435,982 B2 10/2008 Smith
(Continued)

FOREIGN PATENT DOCUMENTS

KR 10-2012-0025625 A 3/2012

OTHER PUBLICATIONS

A. Schreiber et al., Radiation resistance of quartz glass for VUV discharge lamps, Journal of Physics D: Applied Physics, Aug. 19, 2005, p. 3242-3250, vol. 38, IOP Publishing Ltd, Printed in the UK.

*Primary Examiner* — Nicole M Ippolito
*Assistant Examiner* — Sean M Luck
(74) *Attorney, Agent, or Firm* — Suiter Swantz pc llo

(57) ABSTRACT

A laser-sustained plasma lamp includes a gas containment structure configured to contain a volume of gas. The gas containment structure is configured to receive pump illumination from a pump laser for generating a plasma within the volume of gas. The gas containment structure includes one or more transmissive structures being at least partially transparent to the pump illumination from the pump laser and at least a portion of the broadband radiation emitted by the plasma. The one or more transmissive structures have a graded absorption profile so as to control heating of the one or more transmissive structures caused by the broadband radiation emitted by the plasma.

35 Claims, 14 Drawing Sheets

(51) Int. Cl.

| | |
|---|---|
| ***H01J 61/52*** | (2006.01) |
| ***H01J 65/04*** | (2006.01) |
| ***H01J 61/30*** | (2006.01) |

(56) References Cited

U.S. PATENT DOCUMENTS

| | | | | |
|---|---|---|---|---|
| 7,705,331 | B1 | 4/2010 | Kirk et al. | |
| 7,786,455 | B2 | 8/2010 | Smith | |
| 7,989,786 | B2 | 8/2011 | Smith et al. | |
| 8,182,127 | B2 | 5/2012 | Yasuda et al. | |
| 8,309,943 | B2 | 11/2012 | Smith et al. | |
| 8,525,138 | B2 | 9/2013 | Smith et al. | |
| 8,921,814 | B2 | 12/2014 | Pellemans et al. | |
| 9,099,292 | B1 | 8/2015 | Bezel et al. | |
| 9,318,311 | B2 | 4/2016 | Chimmalgi et al. | |
| 9,390,902 | B2 | 7/2016 | Bezel et al. | |
| 2004/0184256 | A1* | 9/2004 | Blanchard | F21V 9/06 362/614 |
| 2004/0201353 | A1 | 10/2004 | Miyazawa | |
| 2007/0236936 | A1* | 10/2007 | Wada | G03B 21/10 362/298 |
| 2011/0181191 | A1 | 7/2011 | Smith et al. | |
| 2013/0154466 | A1* | 6/2013 | Flechsig | H01J 61/35 313/111 |
| 2013/0181595 | A1 | 7/2013 | Bezel et al. | |
| 2014/0029154 | A1 | 1/2014 | Hering et al. | |
| 2015/0034838 | A1 | 2/2015 | Bezel et al. | |
| 2016/0381776 | A1 | 12/2016 | Derstine et al. | |

* cited by examiner

LASER SUSTAINED PLASMA LIGHT SOURCE WITH GRADED ABSORPTION FEATURES

CROSS-REFERENCE TO RELATED APPLICATION

The present application claims benefit under 35 U.S.C. § 119(e) and constitutes a regular (non-provisional) patent application of U.S. Provisional Application Ser. No. 62/263,663, filed Dec. 6, 2015, entitled GRADED COATINGS FOR TEMPERATURE CONTROL OF BULBS AND VUV OPTICAL, naming as inventors Ilya Bezel, Anatoly Shchemelinin, Ken Gross, Matthew Panzer, Anant Chimmalgi, Lauren Wilson and Joshua Wittenberg, which is incorporated herein by reference in the entirety.

TECHNICAL FIELD

The present invention generally relates to plasma-based light sources, and, more particularly, to a plasma-based light source with one or more transparent portions with graded absorption features.

BACKGROUND

As the demand for integrated circuits having ever-smaller device features continues to increase, the need for improved illumination sources used for inspection of these ever-shrinking devices continues to grow. One such illumination source includes a laser-sustained plasma source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as "pumping" the plasma. Traditional plasma lamps include plasma bulbs or cells for containing gas used to generate plasma, which are typically formed from a glass or crystalline material. During operation a plasma lamp may experience temperature gradients caused by the non-uniform heating of the plasma lamp by broadband radiation emitted by the plasma. Strong thermal gradients can cause stress within the plasma lamp, which in some cases cause mechanical failure. For example, when powerful broadband radiation passes through a window of a plasma lamp, thermal stress caused by preferential window heating in the center of the window can cause the window to crack. Therefore, it would be desirable to provide an apparatus, system and/or method for curing shortcomings such as those of the identified above.

SUMMARY

An optical device having graded absorption characteristics is disclosed, in accordance with one or more embodiments of the present disclosure. In one embodiment, the optical device includes an optical component including at least one of a reflective element or a transmission element. In another embodiment, the optical device includes one or more graded absorption layers disposed on one or more surfaces of at least one of the reflective element or the transmission element. In another embodiment, the one or more graded absorption layers control heating of at least one of the reflective element or the transmission element caused by the broadband radiation emitted by a plasma.

A laser-sustained plasma (LSP) lamp having graded absorption characteristics is disclosed, in accordance with one or more embodiments of the present disclosure. In one embodiment, the LSP lamp includes a gas containment structure configured to contain a volume of gas. In another embodiment, the gas containment structure is configured to receive pump illumination from a pump laser for generating a plasma within the volume of gas. In another embodiment, the plasma emits broadband radiation. In another embodiment, the gas containment structure includes one or more transmissive structures being at least partially transparent to at least a portion of the pump illumination from the pump laser and at least a portion of the broadband radiation emitted by the plasma. In another embodiment, the one or more transmissive structures have a graded absorption profile so as to control heating of the one or more transmissive structures caused by the broadband radiation emitted by the plasma.

A system for generating broadband laser-sustained plasma light is disclosed, in accordance with one or more embodiments of the present disclosure. In one embodiment, the system includes one or more pump lasers configured to generate illumination. In another embodiment, the system includes a plasma lamp. In another embodiment, the plasma lamp includes a gas containment structure configured to contain a volume of gas, the gas containment structure configured to receive pump illumination from a pump laser for generating a plasma within the volume of gas, wherein the plasma emits broadband radiation. In another embodiment, the gas containment structure includes one or more transmissive structures being at least partially transparent to at least a portion of the pump illumination from the pump laser and at least a portion of the broadband radiation emitted by the plasma. In another embodiment, the one or more transmissive structures have a graded absorption profile so as to control heating of the one or more transmissive structures caused by the broadband radiation emitted by the plasma. In another embodiment, the system includes one or more lamp optics arranged to focus the illumination from the one or more pump lasers into the volume of gas in order to generate a plasma within the volume of gas contained within the plasma lamp.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1A:
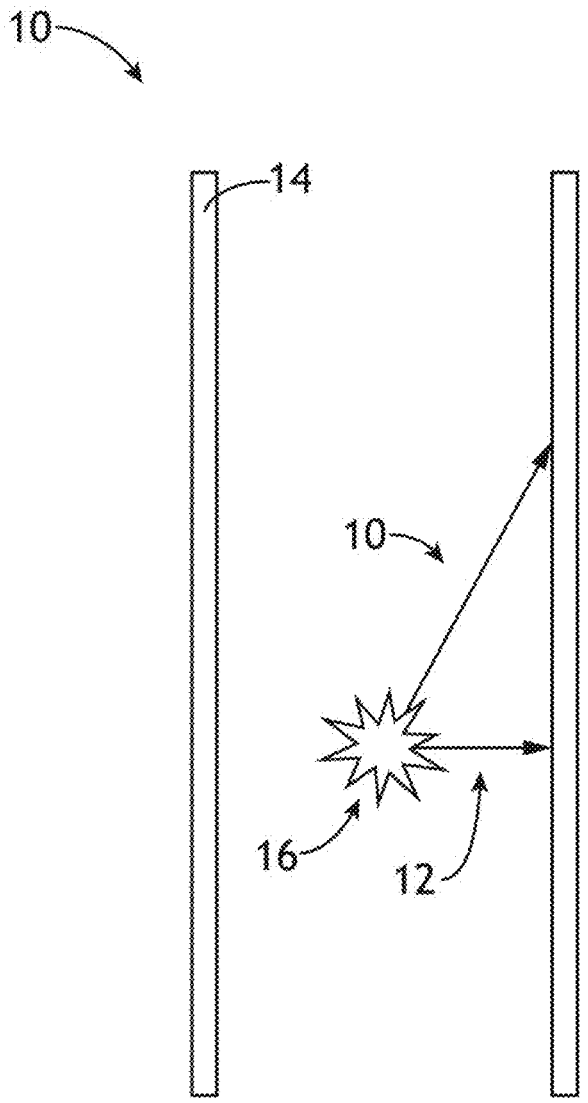
FIG. 1A is a cross-section view of gas containment structure of a plasma lamp experiencing a temperature gradient caused by a variation in the intensity of the radiation emitted by a plasma, in accordance with one or more embodiments of the present disclosure.

Reference will now be made in detail to the subject matter disclosed, which is illustrated in the accompanying drawings.

Referring generally to FIGS. 1A through 5B, a laser sustained plasma (LSP) broadband illumination source equipped with graded absorption features is described in accordance with the present disclosure. Some embodiments of the present disclosure are directed to the generation of radiation with a light-sustained plasma light source. The light-sustained plasma light source may include a plasma lamp equipped with a transmission element (e.g., transparent wall of a plasma bulb, transparent wall of a plasma cell, window, etc.) that is at least partially transparent to both the pumping light (e.g., light from a laser source) used to sustain a plasma within the plasma lamp as well as the broadband radiation emitted by the plasma. Some embodiments of the present disclosure provide for one or more graded absorption layers formed on one or more transparent portions of the plasma lamp. Other embodiments of the present disclosure provide for bulk doping of one or more transparent portions of the plasma lamp so to provide a graded absorption profile in the one or more transparent portions of the plasma lamp.

The one or more graded absorption layers and/or bulk doping may be used in the context of any optical system requiring one or more transparent, semi-transparent and/or reflective interfaces. The one or more absorption layers may be used in any number of high temperature optical environments.

Lack of control of the light absorption in an optical component may result in strong thermal gradients in an optical component in close proximity to the plasma. Many of optical materials in use in LSP containers (e.g., plasma bulbs, cells, chambers) are relatively brittle and do not withstand strong thermal gradients. Strong thermal gradients can cause stress, especially on larger optical components that may ultimately lead to mechanical failure of the optical component.

For windows and other transmitting optical components, thermal management becomes important so to reduce stress caused by non-uniform heating. One of the main causes of stress in optical components, such as, but not limited to, transmission elements (e.g., window) of plasma cells or plasma bulbs is surface absorption of VUV light emitted by the plasma. For high intensity applications, thermal stress can exceed material strength of the transmission element, thereby causing catastrophic failure of the transmission element. The implementation of a graded absorption layer and/or the bulk doping of the transmission element to achieve graded absorption may provide for a controlled pattern of stress distribution.

The generation of a light-sustained plasma is also generally described in U.S. Pat. No. 7,435,982, issued on Oct. 14, 2008, which is incorporated by reference herein in the entirety. The generation of plasma is also generally described in U.S. Pat. No. 7,786,455, issued on Aug. 31, 2010, which is incorporated by reference herein in the entirety. The generation of plasma is also generally described in U.S. Pat. No. 7,989,786, issued on Aug. 2, 2011, which is incorporated by reference herein in the entirety. The generation of plasma is also generally described in U.S. Pat. No. 8,182,127, issued on May 22, 2012, which is incorporated by reference herein in the entirety. The generation of plasma is also generally described in U.S. Pat. No. 8,309,943, issued on Nov. 13, 2012, which is incorporated by reference herein in the entirety. The generation of plasma is also generally described in U.S. Pat. No. 8,525,138, issued on Feb. 9, 2013, which is incorporated by reference herein in the entirety. The generation of plasma is also generally described in U.S. Pat. No. 8,921,814, issued on Dec. 30, 2014, which is incorporated by reference herein in the entirety. The generation of plasma is also generally described in U.S. Pat. No. 9,318,311, issued on Apr. 19, 2016, which is incorporated by reference herein in the entirety. The generation of plasma is also generally described in U.S. Patent Publication No. 2014/029154, filed on Mar. 25, 2014, which is incorporated by reference herein in the entirety. In a general sense, the various embodiments of the present disclosure should be interpreted to extend to any plasma-based light source known in the art. An optical system used in the context of plasma generation is described generally in U.S. Pat. No. 7,705,331, issued on Apr. 27, 2010, which is incorporated herein by reference in the entirety. The use of separate illumination and collection optics in a plasma source is described generally in U.S. patent application Ser. No. 15/187,590, filed on Jun. 20, 2016, which is incorporated above by reference in the entirety. The generation of plasma in a bulb-less light source is generally described in U.S. patent application Ser. No. 14/224,945, filed on Mar. 25, 2014, which is incorporated above in the entirety. A bulb-less laser sustained plasma light source is also generally described in U.S. patent application Ser. No. 12/787,827, filed on May 26, 2010, which is incorporated herein by reference in the entirety.

Figure 1B:
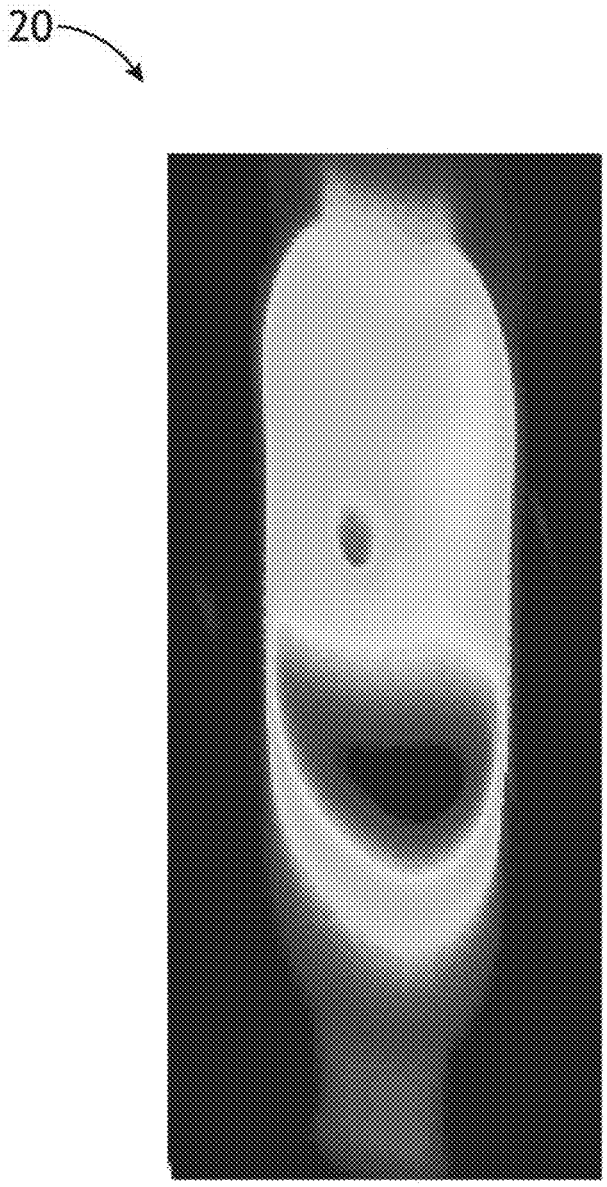
FIG. 1B is a thermal image of gas containment structure of a plasma lamp experiencing a temperature gradient caused by a variation in the intensity of the radiation emitted by a plasma, in accordance with one or more embodiments of the present disclosure.
Figure 1C:
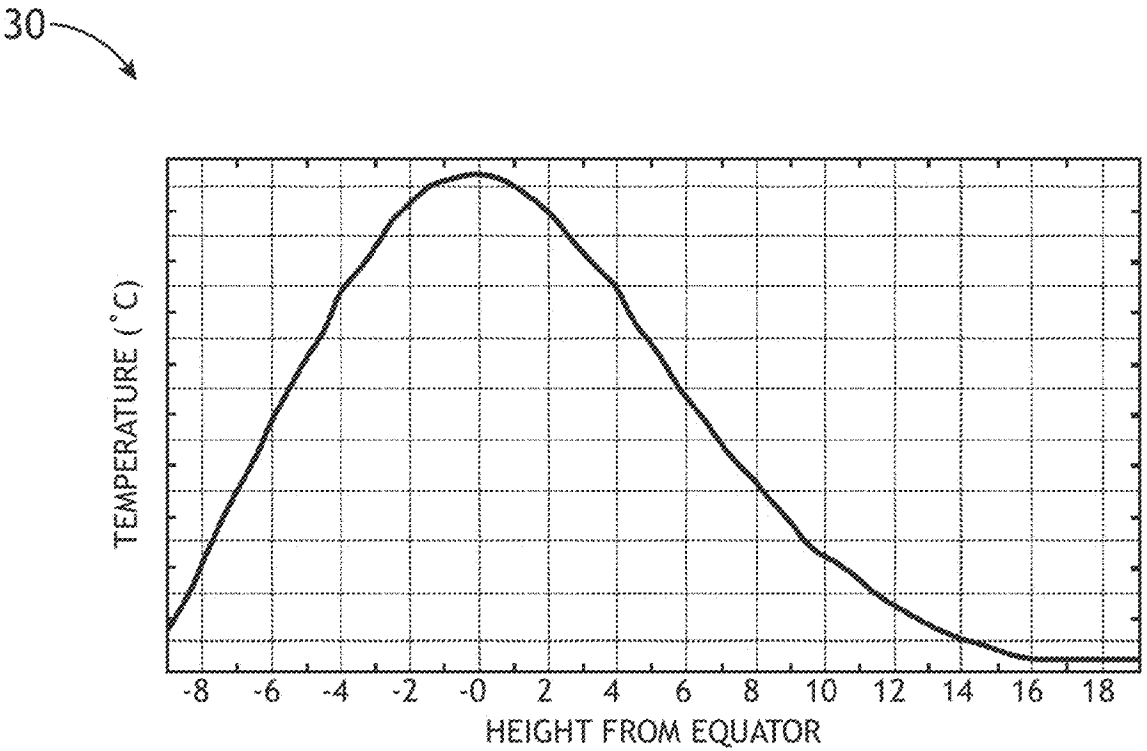
FIG. 1C is a graph of temperature versus height from the equator of a gas containment structure of a plasma lamp experiencing a temperature gradient caused by a variation in the intensity of the radiation emitted by a plasma, in accordance with one or more embodiments of the present disclosure.

FIGS. 1A-1C illustrate the cause and impact of non-uniform heating in a plasma lamp, in accordance with one or more embodiments of the present disclosure. It is noted herein that thermal distribution of the bulb envelope of a plasma lamp is established by the balance of heat delivered to the wall of the bulb (primarily through absorbed plasma radiation and convection) and cooling, primarily through forced air convection on the outside of the bulb and thermal radiation. Similarly, the temperature distributions of optical components of plasma cells and chambers are established through the balance of heating by absorbed radiation and cooling (e.g., convective or water cooling).

FIG. 1A is a cross-section view of gas containment structure of a plasma lamp 10 experiencing a temperature gradient caused by a variation in the intensity of the radiation 10, 12 emitted by a plasma 16, in accordance with one or more embodiments of the present disclosure. It is noted that the main radiative heat source is the LSP and the heat generation on the transmission element 14 of gas containment structure is dictated by the distance from the wall of the transmission element 14 of the gas containment structure to LSP, LSP emission spectrum, and/or the absorptivity of the transmission element 14. Currently, the optical components that are close to LSP (e.g., equatorial part of a cylindrical bulb) have higher temperature and those remote from the plasma have lower temperature. FIG. 1B is a thermal image 20 of a bulb of a plasma lamp experiencing a temperature gradient caused, at least in part, by a variation in the intensity of the radiation emitted by a plasma, in accordance with one or more embodiments of the present disclosure. FIG. 1C is a graph 30 of temperature versus height from the equator of a bulb of a plasma lamp (where height=0 corresponds to the equator) of a plasma lamp experiencing a temperature gradient caused by a variation in the intensity of the radiation emitted by a plasma, in accordance with one or more embodiments of the present disclosure.

Figure 1D:
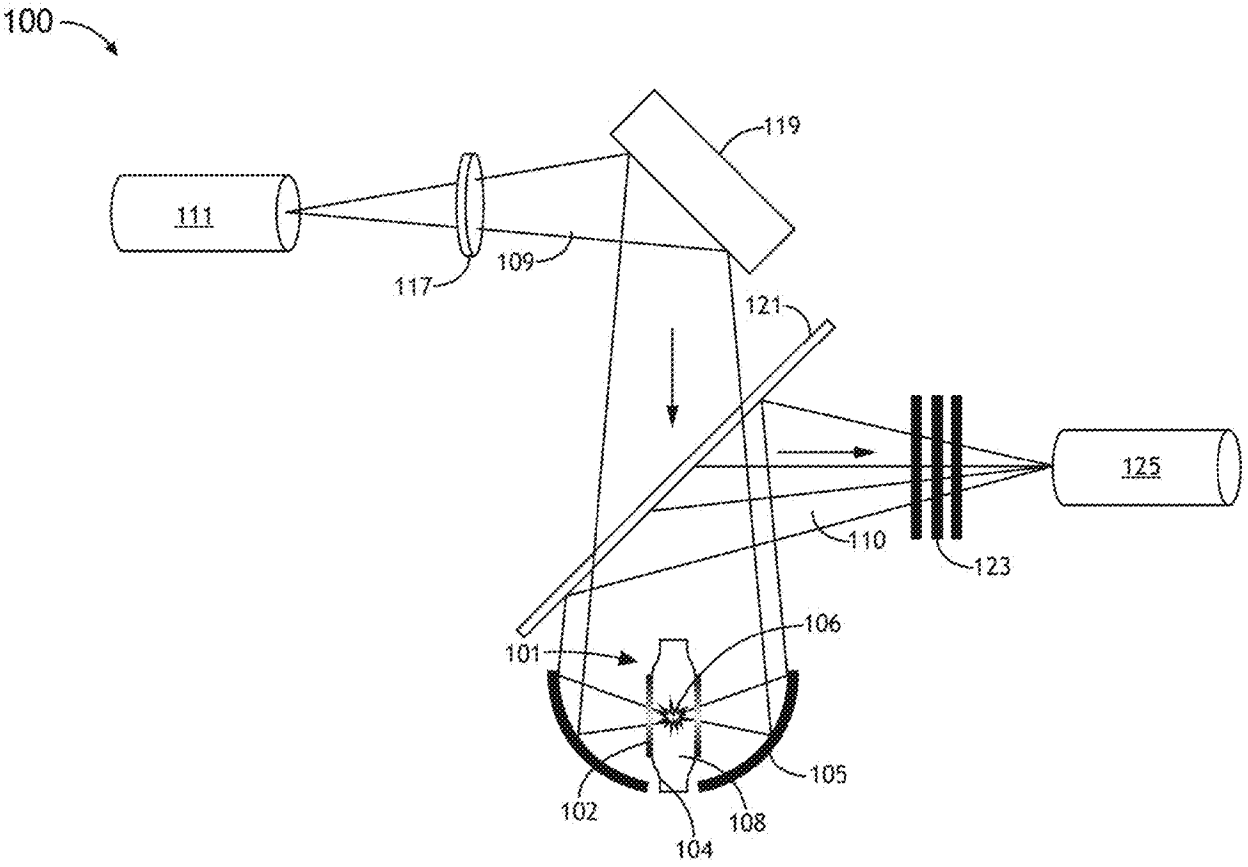
FIG. 1D illustrates a high level schematic view of a system for generating plasma-based broadband radiation equipped with one or more graded absorptive layers dispose on a transmission element of the plasma lamp of the system, in accordance with one or more embodiments of the present disclosure.

FIG. 1D illustrates a system 100 for forming laser-sustained plasma equipped with a plasma lamp 101 equipped with one or more graded absorption features, in accordance with one or more embodiments of the present disclosure.

In one embodiment, the system 100 includes an illumination source 111 (e.g., one or more lasers) configured to generate illumination 109 of a selected wavelength or wavelength range, such as, but not limited to, infrared radiation or visible radiation. In another embodiment, the system 100 includes a plasma lamp 101 for generating, or maintaining, plasma 106. In another embodiment, the plasma lamp 101 includes one or more gas containment structures 103 (e.g., plasma bulb, plasma cell, plasma chamber, etc.) having one or more transmission elements 104 (e.g., transparent or semi-transparent optical element). For example, the one or more transmission elements 104 may include, but are not limited to, a transparent or semi-transparent window, wall of a plasma bulb, wall of a plasma cell and the like. In one embodiment, the transmission element 104 of the gas containment structure 103 of the plasma lamp 101 is configured to receive illumination from the illumination source 111 in order to generate a plasma 106 within a plasma generation region of a volume of gas 108 contained within the plasma lamp 101. In this regard, one or more transmission elements 104 of the gas containment structure 103 of the plasma lamp 101 are at least partially transparent to the illumination generated by the illumination source 111, allowing illumination delivered by the illumination source 111 (e.g., delivered via fiber optic coupling or delivered via free space coupling) to be transmitted through the transmission element 104 and into the plasma lamp 101. In another embodiment, upon absorbing illumination from illumination source 111, the plasma 106 emits broadband radiation (e.g., broadband IR, broadband visible, broadband UV, broadband DUV, broadband VUV and/or broadband EUV radiation). In another embodiment, one or more transmission elements 104 of the gas containment structure 103 of the plasma lamp 101 are at least partially transparent to at least a portion of the broadband radiation emitted by the plasma 106. It is noted herein that the one or more transmission elements 104 of the gas containment structure 103 of the plasma lamp 101 may be transparent to both illumination 107 from the illumination source 111 and broadband illumination 115 from the plasma 106.

In another embodiment, the plasma lamp 101 is equipped with one or more graded absorption features 102.

Figure 1E:
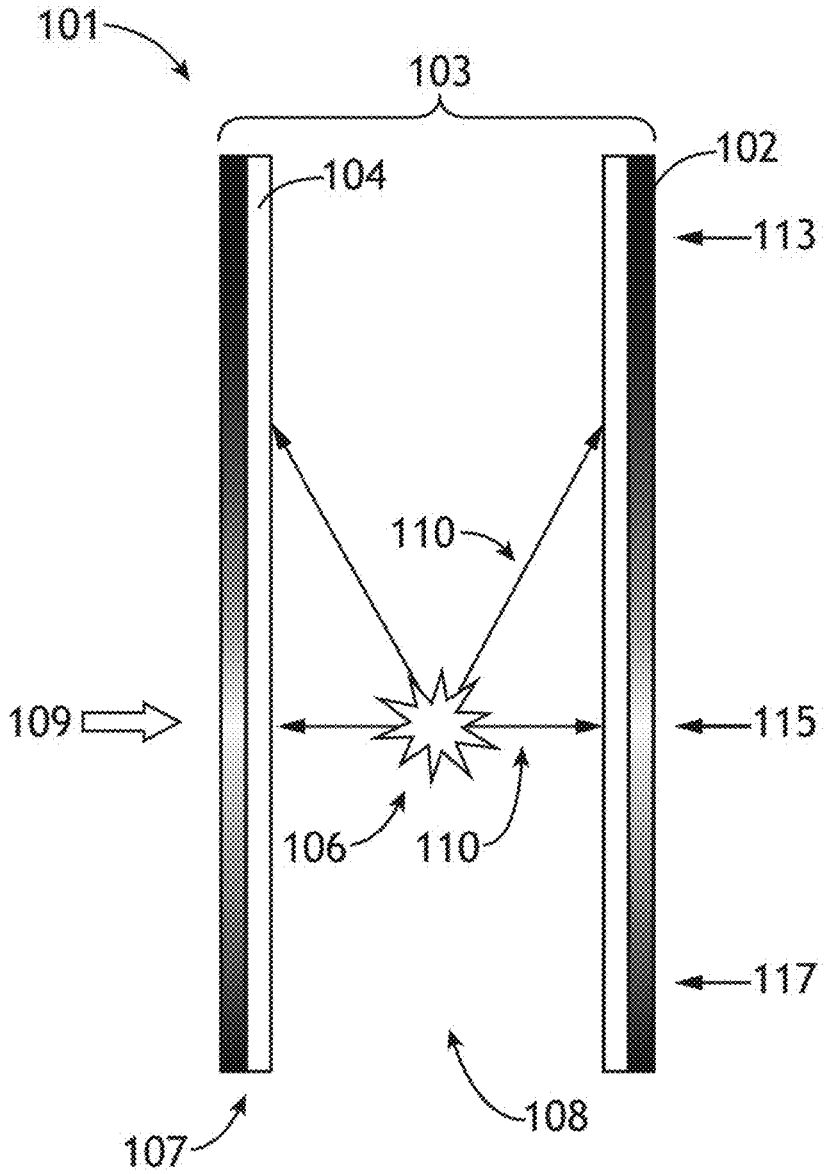
FIG. 1E illustrates a cross-section view of gas containment structure of a plasma lamp equipped with a graded absorptive layer to establish uniform heating along the gas containment structure, in accordance with one or more embodiments of the present disclosure.

FIG. 1E illustrates a portion of a plasma lamp 101 equipped with one or more graded absorption features 102, in accordance with one or more embodiments of the present disclosure. In one embodiment, the gas containment structure 103 of the plasma lamp 101 includes a transmissive structure 107. The transmissive structure 107 is at least partially transparent to at least a portion of the pump illumination 109 from the pump laser 111 and at least a portion of the broadband radiation emitted 110 by the plasma 106. In another embodiment, the transmissive structure 107 has a graded absorption profile so as to control heating of the one or more transmissive structures caused by the broadband radiation emitted by the plasma 106.

In one embodiment, the transmissive structure 107 includes the transmission element 104 (e.g., wall of bulb, wall of plasma cell, window, etc.) and one or more graded absorptive layers 102 disposed on a surface of the transmission element 104. For example, the transmission element 104 may include an otherwise generally non-absorptive transmission element, such as, but not limited to, a wall of a plasma bulb, a wall of a plasma cell, a window of a plasma chamber and the like. A graded absorptive layer 102 may be disposed on one or more surfaces of the transmission element 104 so to achieve the graded absorption profile of the transmissive structure 107.

It is noted that grade absorptive layer 102 may be formed to achieve a selected thermal distribution of the transmission element 104 (or other optical components).

In one embodiment, the absorptive layer 102 may be formed on a surface of the transmission element 104 so as to approximately inversely match the intensity profile of the broadband radiation 110 impinging on the transmission element 104. In this regard, the absorptivity of the absorptive layer 102 may vary inversely to the intensity profile of the broadband radiation 110 so as to reduce the thermal gradient along one or more directions (e.g., axial direction) of the transmissive structure 107 of the gas containment structure 103. Such an absorptivity distribution in the absorptive layer 102 may aid in achieving a uniform temperature distribution across the transmission element 104, thereby reducing stress in the transmission element 104 and also providing an appropriate temperature for solarization annealing. It is further noted that the achievement of uniform temperature along one or more directions (e.g., axial direction in cylindrical geometry) of the transmission element 104 (or other optical components) is particularly desirable in cases of brittle transmission elements 104 formed from materials such as, but not limited to, $Al_2O_3$, $CaF_2$, $MgF_2$ and the like.

In one embodiment, the absorptivity of the absorptive layer 102 may vary continuously along a selected direction (e.g., axial direction in the case of cylindrical geometry). For example, the absorptive layer 102 may be formed such that that the absorptivity of the absorptive layer is minimum at the point of maximum broadband radiation intensity 115, while being maximum at the point(s) of minimum broadband radiation intensity 113,117. For instance, in the case of a cylindrical gas containment structure 103, as shown in FIG. 1E, the graded absorption profile of the absorptive layer 102 is such that the absorptivity of the absorptive layer is maximum at one or more end portions 113, 117 of the gas containment structure 103 and a minimum at an equatorial portion 115 of the gas containment structure 103. In this example, application of the absorptive layer 102 such that it has high absorptivity near the top/bottom edges 113, 117 of the transmission element 104 (e.g., window) than the center 105 may allow for a controlled pattern of stress distribution, whereby the resulting thermal profile leads to smaller radial stress in the transmission element 104. For example, the absorptivity of the absorptive layer 102 may have a maximum absorptivity between 10-100% and a minimum absorptivity as low as 0% (see FIG. 1H for the case where maximum absorptivity is 20%).

The absorptive layer 102 may be disposed on the internal surface and/or the external surface of the transmission element 104 of the plasma lamp 101. It is also noted that application of the absorptive layer 102 on both sides (i.e., internal surface and external surface) of the transmission element 104 may serve to aid in managing longitudinal stress distribution in the transmission element 104.

In one embodiment, the absorptive layer 102 includes an absorptive coating deposited/formed on one or more surfaces of the transmission element 104. The absorptive layer 102 may be formed such that the absorptivity of the absorptive layer 102 varies along one or more directions as necessary to mitigate thermal gradients that would otherwise exist in the transmission element 104. The absorptivity of the layer 102 as a function of position along the transmission element 104 may be controlled by controlling the density of the material used to form the absorptivity layer. In another embodiment, multiple materials having different absorptivities may be used to control absorptivity as a function position along the transmission element 104.

The absorptive layer 102 may be deposited utilizing any thin film deposition process known in the art, such as, but not limited to, evaporation, sputtering, chemical vapor deposition (CVD), atomic layer deposition (ALD) and the like.

It is noted that the materials used to form the graded absorptive layer 102 may include any materials known in the optical arts for forming absorptive optical components coatings/layers. In some embodiments, the absorptive layer 102 may be formed from one or more materials that absorb all or a significant portion of the spectrum of the broadband radiation 110. For example, the absorptive layer 102 may be formed from such broadly absorbing materials as, but not limited to, aluminum or carbon. In other embodiments, the absorptive layer 102 may be formed from one or more materials that absorb a fraction of the spectrum of the broadband radiation 110. For example, the absorptive layer 102 may be formed from such fractionally absorbing materials as, but not limited to, hafnium.

It is further noted that the absorptive layer 102 may be formed from a material that has an absorption spectrum away from the usable spectral band of the LSP source 101. By limiting absorption by the absorptive layer 102 to non-usable spectral portions of the broadband radiation 110, stress in the transmission element 104 may be reduced, via thermal gradient reduction, while light output performance is not impacted. For example, in the case where visible light is collected from the plasma 106, a hafnium-based graded absorptive layer 102 may be implemented so to absorb non-usable UV light from the broadband output of the plasma 106.

Figure 1F:
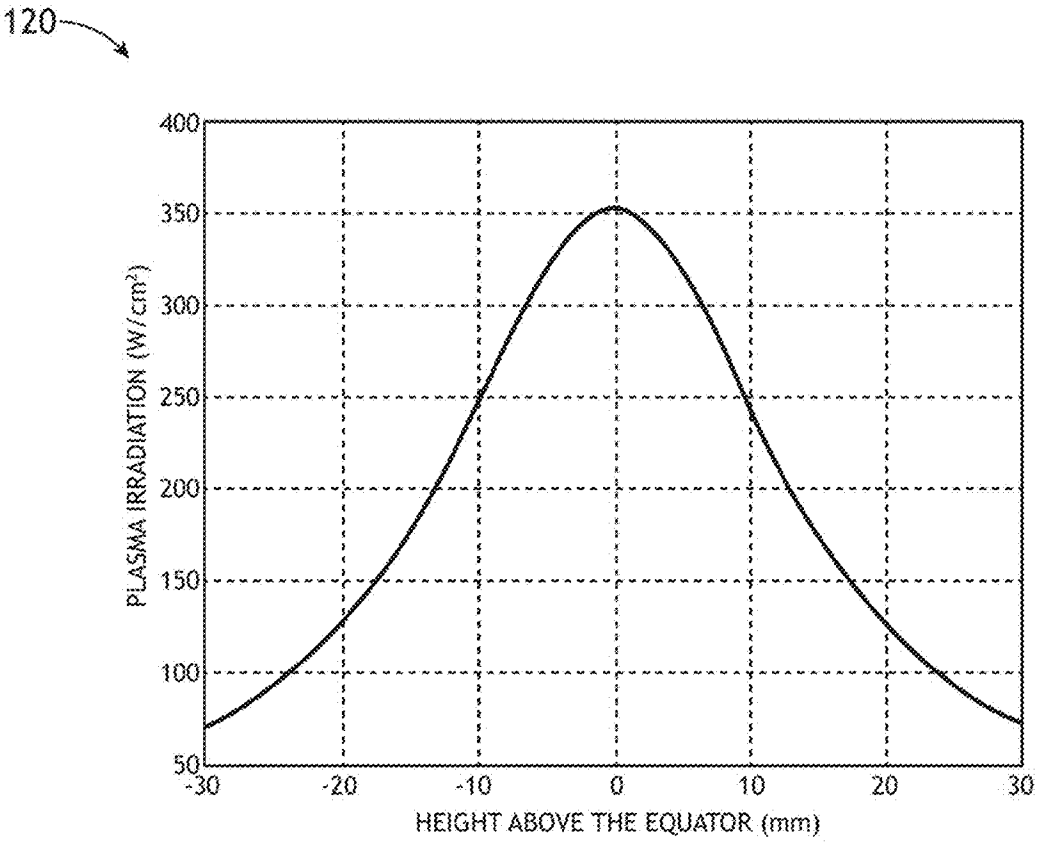
FIG. 1F illustrates a graph of plasma irradiation versus height from the equator of a gas containment structure of a plasma lamp experiencing a temperature gradient caused by a variation in the intensity of the radiation emitted by a plasma, in accordance with one or more embodiments of the present disclosure.
Figure 1G:
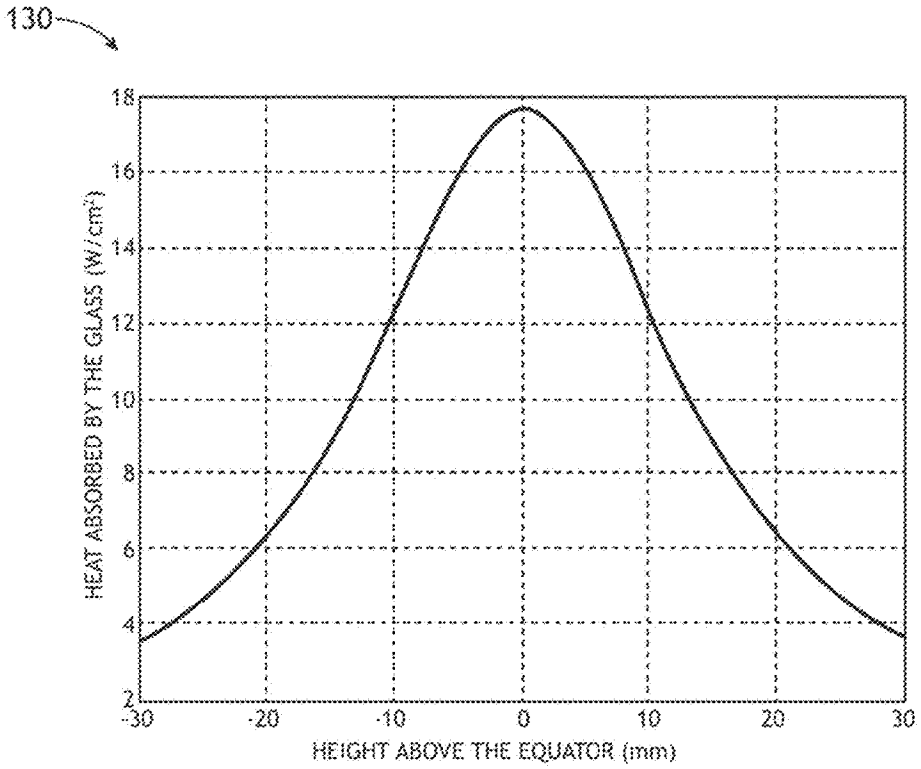
FIG. 1G illustrates a graph of heat absorbed by a gas containment structure versus height from the equator of the gas containment structure of a plasma lamp experiencing a temperature gradient caused by a variation in the intensity of the radiation emitted by a plasma, in accordance with one or more embodiments of the present disclosure.
Figure 1H:
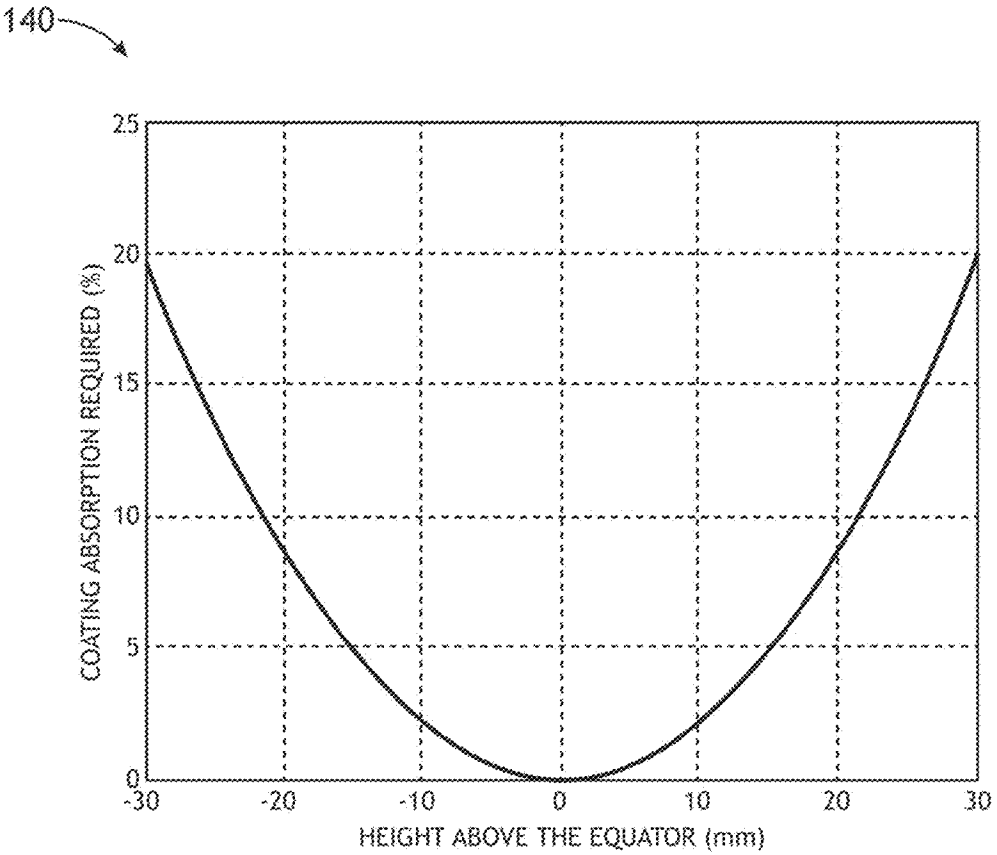
FIG. 1H illustrates a graph of the coating absorption required, as a function of height above the equator, by the transmission element to offset thermal gradients in the transmission caused by a variation in the intensity of the radiation emitted by a plasma, in accordance with one or more embodiments of the present disclosure.

FIGS. 1F-1H illustrate an example of the relationship between light output of the light source 100 and a graded absorptive layer 102 suited for mitigating thermal stress within the transmission element 104 of the light source 100, in accordance with one or more embodiments of the present disclosure. In this example, it is assumed the light source includes a cylindrical lamp (e.g., cylindrical lamp including crystalline or glass gas containment structure) having a diameter of 30 mm diameter (R=15 mm) for which a uniform temperature distribution needs to be maintained with z=±30 mm from the equatorial plane of a plasma having a power output of P=10 kW. The absorptivity of the absorptive layer 102 may be calculated using the following formula:

$$A[\%] = \frac{\max(Q) - Q}{W} * 100\%$$

where W is distribution of radiation flux on the transmission element 104 (e.g., glass wall) of the gas containment structure 103 and is given by:

$$W = \frac{P_{plasma}}{4\pi(R^2 + z^2)}$$

where Q is the power density absorbed by the transmission element 104 of the gas containment structure e.g., glass wall(s) of gas containment structure) and is given by:

$$Q = A_{glass} \cdot W$$

where $A_{glass}$ is the absorptivity of the glass cylindrical transmission element 104 of the gas containment structure 103.

FIG. 1F illustrates graph 120 depicting plasma irradiation as a function of height below and above the equator of the gas containment structure 103. FIG. 1G depicts the heat absorbed 130 by the glass of the transparent portion 104 of the gas containment structure 103, in the case of 5% absorption of the glass (i.e., $A_{glass}$=5%). FIG. 1H illustrates graph 140 depicting the coating absorption (in %) for mitigating the temperature gradient and establishing a uniform temperature along the z-direction of the transmission element 104, in accordance with one or more embodiments of the present disclosure. In this example, the maximum absorptivity is 20% absorption at the end portions of the gas containment structure 103 and 0% absorption at the equator. It is noted herein that this example is not a limitation on the scope of the present disclosure and is provided merely for illustrative purposes.

Figure 2B:
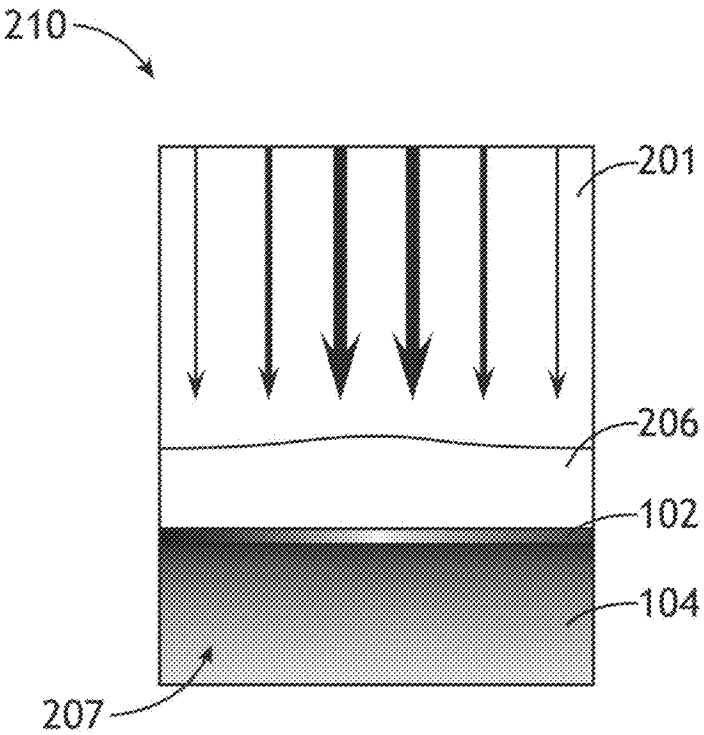
FIGS. 2A-2B illustrate conceptual views of surface absorption by the transmission element of the plasma lamp without and with the graded absorptive layer, in accordance with one or more embodiments of the present disclosure.
Figure 2A:
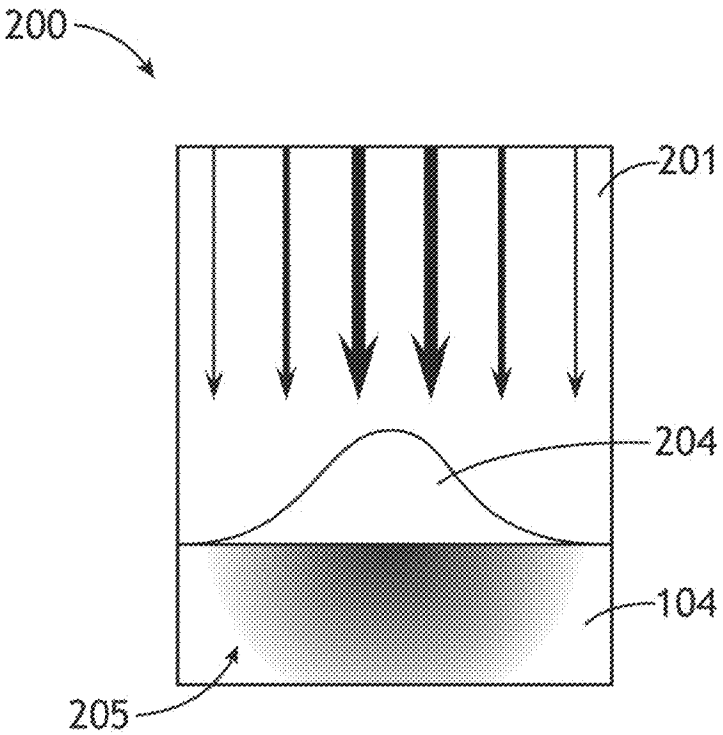

FIGS. 2A-2B illustrates conceptual views 200, 210 of surface absorption by the transmission element 104 of the plasma lamp 104 without and with the graded absorptive layer 102. As shown in FIG. 2A, in the case where no graded absorptive layer 102 is present, light having an intensity gradient impinges on the wall of the transmission element 104. It is noted that the amount of light absorbed along the transmission element is a function of intensity of the light along the transmission element 104. In this regard, the more intense the light at a particular location the more light is absorbed at that location. Curve 204 conceptually illustrates the absorbed light as a function of position along the transmission element. The absorption of the light having an intensity gradient then causes strong temperature gradients 205 within the wall of the transmission element 104 through absorption of the light 201. In contrast, as shown in FIG. 2B, the application of the graded absorptive layer 102 acts to smooth out the amount of light absorbed along the transmission element 104. In this regard, by increasing the absorptivity as a function of decreasing intensity of light 201 the amount of light absorbed at each location along the transmission element 104 can be smoothed out so to approach a constant value. Curve 206 conceptually illustrates the absorbed light as a function of position along the transmission element 104. In turn, the uniform absorption along the transmission element 104 then causes weak temperature gradients 207 as compared to those observed in the case with no graded absorptive layer.

Figure 3A:
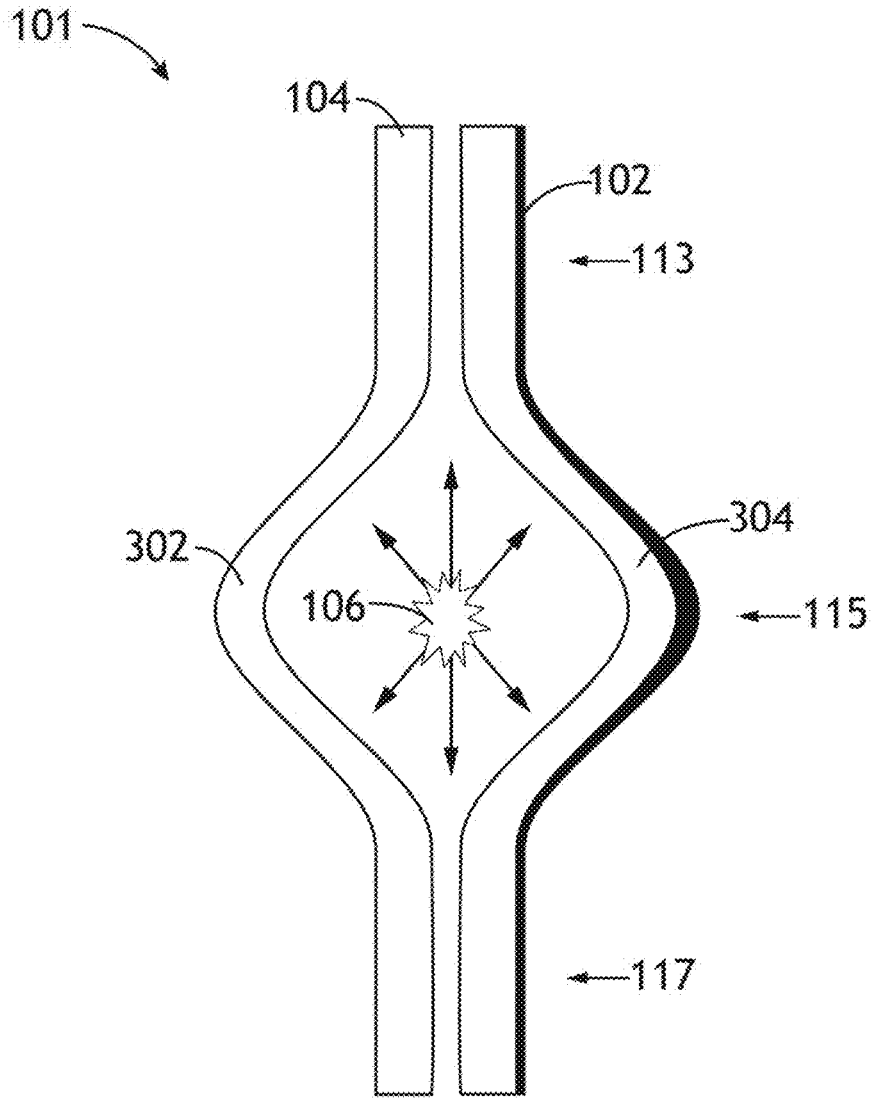
FIG. 3A illustrates a simplified schematic view of a graded absorption layer disposed on a plasma bulb experiencing directional cooling, in accordance with one or more embodiments of the present disclosure.

FIG. 3A illustrates a simplified schematic view of a graded absorption layer disposed on a plasma bulb experiencing directional cooling, in accordance with one or more embodiments of the present disclosure. It is noted that in this configuration directional cooling may cause less heating (more cooling) of one side 304 of the plasma bulb 101, causing the opposite side 302 of the plasma bulb 101 to experience higher heating than side 304. In this example, the graded absorption layer 102 may be disposed on the side 304 experiencing more cooling so as to increase absorption of broadband radiation 110 on the side 304 and create a more uniform temperature distribution across the plasma bulb 101.

Figure 3B:
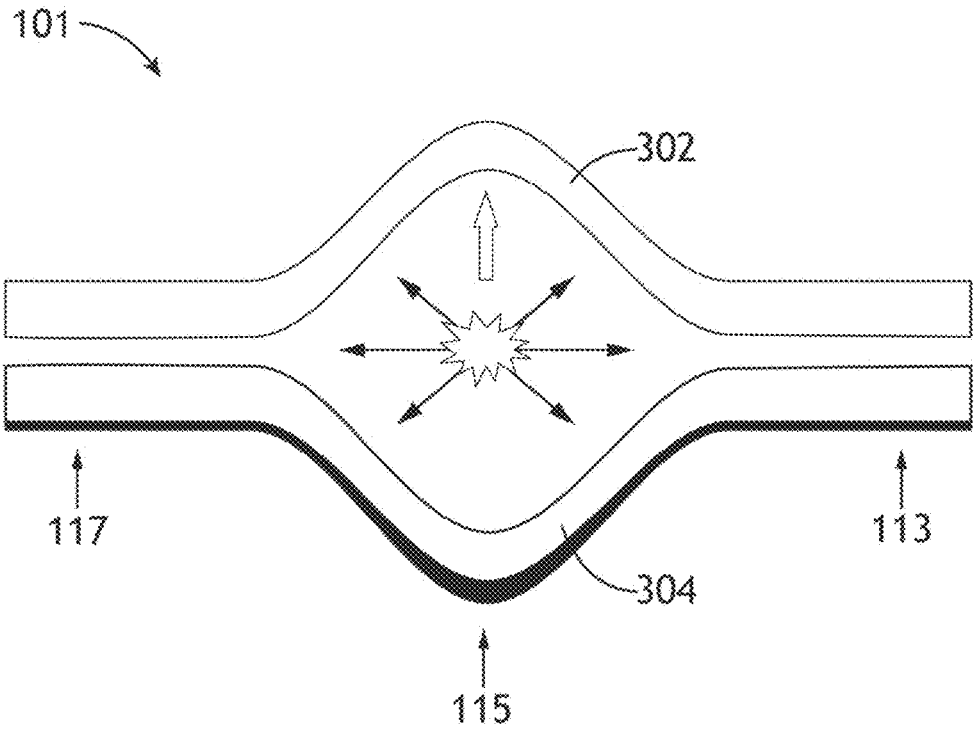
FIG. 3B illustrates a simplified schematic view of a graded absorption layer disposed on a horizontally-oriented plasma bulb, in accordance with one or more embodiments of the present disclosure.

FIG. 3B illustrates a simplified schematic view of a graded absorption layer disposed on a horizontally-oriented plasma bulb, in accordance with one or more embodiments of the present disclosure. It is noted that in this horizontal configuration the convective plume 301 may cause additional heating of the top portion 302 of the plasma bulb 101. In this example, the graded absorption layer 102 may be disposed on the bottom portion 304 of the plasma lamp 101 so as to increase absorption of broadband radiation 110 so to create a more uniform temperature distribution across the plasma bulb 101.

Figure 4:
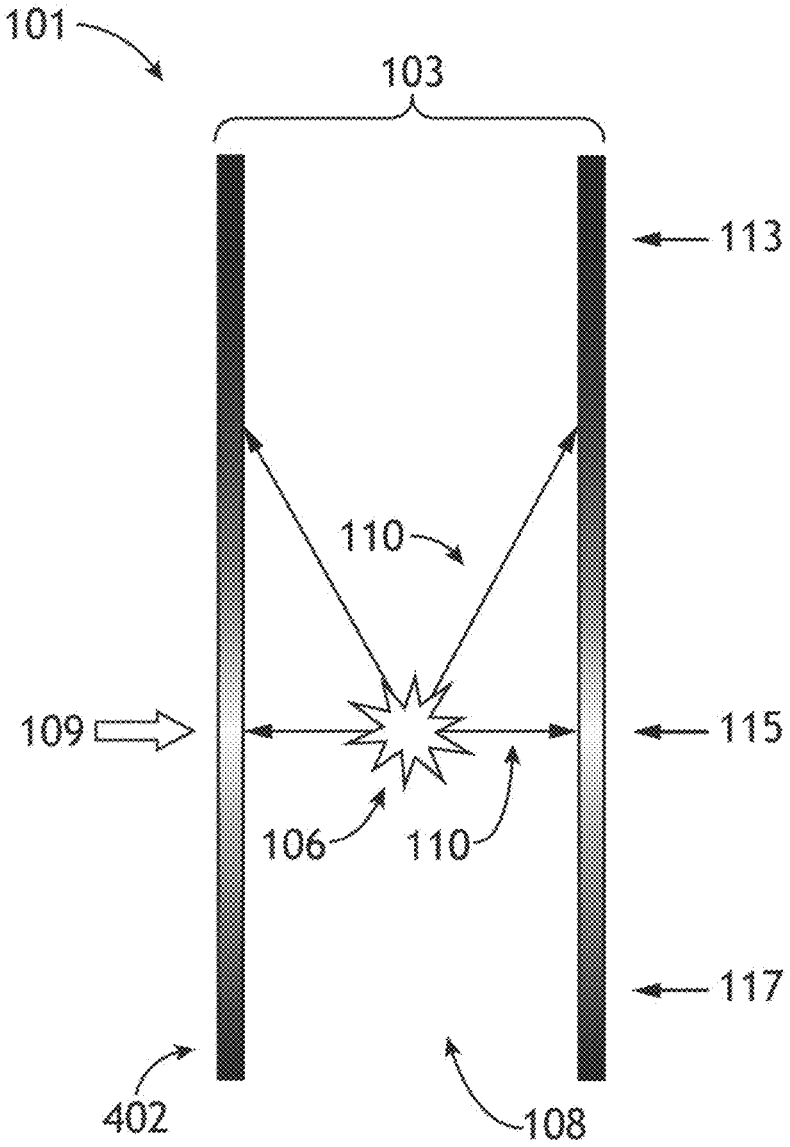
FIG. 4 illustrates a cross-section view of a gas containment structure of a plasma lamp including a transmissive structure doped with absorbing material to form a graded absorption profile along the gas containment structure, in accordance with one or more embodiments of the present disclosure.

FIG. 4 illustrates a cross-section view of a gas containment structure of a plasma lamp including a transmissive structure doped with absorbing material to form a graded absorption profile along the gas containment structure, in accordance with one or more embodiments of the present disclosure. While much of the present disclosure has focused on the implementation of a graded absorption layer 102 disposed on a surface of an otherwise transparent/semi-transparent transmission element of a plasma bulb or plasma cell, this configuration should not be interpreted as a limitation on the scope of the present disclosure. In an alternative and/or additional embodiment, the absorption profile of a plasma lamp 101 may be controlled by bulk doping the transmission element of a gas containment structure 103 of a plasma lamp 101. For example, as shown in FIG. 4, the one or more transmissive structures of the gas containment structure 103 includes a transmission element 402 (e.g., wall of plasma lamp, wall of plasma cell, window and the like) doped so as to have a graded absorption profile. In this regard, during fabrication of the given transmission element, an absorbing material is doping into the bulk material used to form the transmissive element in such a way to produce a graded absorption profile along one or more directions of the given transmission element.

Figure 5A:
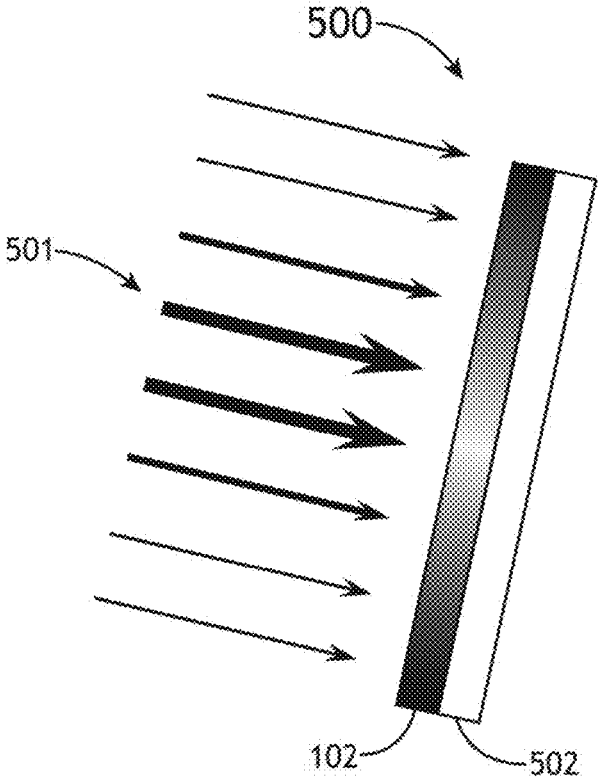
FIG. 5A illustrates a cross-section view of a graded absorption layer disposed on a transparent optical component, in accordance with one or more embodiments of the present disclosure.

While much of the above disclosure has focused on the implementation of a graded absorption layer (or bulk doping) to reduce temperature gradients in the transmissive portions of a plasma lamp 101, these examples should not be interpreted as a limitation on the scope of the present disclosure. Rather, it is noted herein that the implementation of a graded absorption layer and/or the doping of a bulk transparent material may be extended to any type of optical component where temperature gradients may be formed in the given optical component via the absorption of light, as discussed previously herein. For example, the implementation of the graded absorption layer and/or the doping of a bulk material with absorbing material may be extended to any transmissive and/or reflective optical component known in the art including, but not limited to, a window, a lens, a mirror, a beam splitter and the like. FIG. 5A illustrates a cross-section view 500 of a graded absorption layer 102 disposed on a transparent or semi-transparent optical component 502, in accordance with one or more embodiments of the present disclosure. In one embodiment, the optical component 502 may include a transmission element (e.g., glass or crystal piece). In one embodiment, the transparent or semi-transparent optical component 502 may include a window (e.g., window of a plasma chamber). In another embodiment, the transparent or semi-transparent optical component may include a lens. In another embodiment, the transparent or semi-transparent optical component may include a beam splitter (nothing that a beam splitter may include both transmissive and reflective components). The graded absorption layer 102 may be formed such that the absorptivity of the layer corresponds with the intensity profile of the non-uniform light 501 incident on the layer 102 so that the most intense light impinges on the least absorptive portion of the layer 102.

Figure 5B:
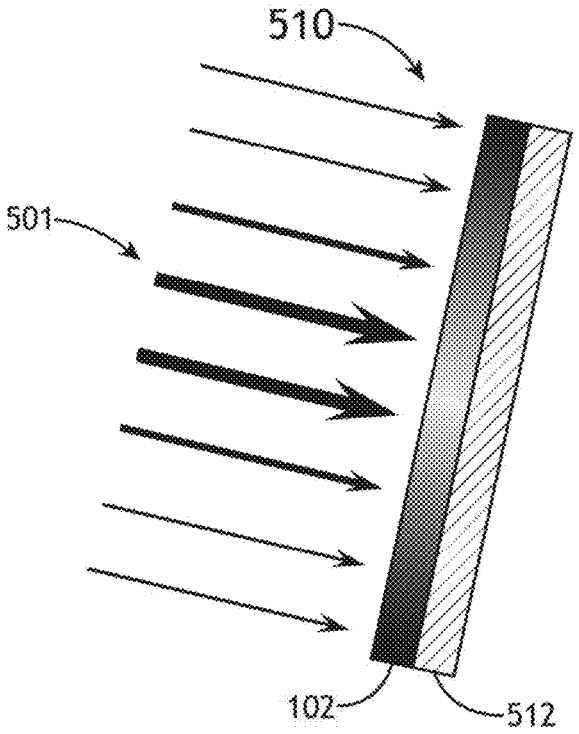
FIG. 5B illustrates a cross-section view of a graded absorption layer disposed on a reflective optical component, in accordance with one or more embodiments of the present disclosure.

FIG. 5B illustrates a cross-section view of a graded absorption layer disposed on a reflective or semi-reflective optical component 510, in accordance with one or more embodiments of the present disclosure. In one embodiment, the optical component 510 includes a reflective element (e.g., glass or crystal piece coated in reflective material). In one embodiment, the reflective or semi-reflective optical component may include a mirror. For example, the reflective or semi-reflective optical component may include a dichroic mirror. In another embodiment, the reflective or semi-reflective optical component may include a reflector or collector. In another embodiment, the reflective or semi-reflective optical component may include a beam splitter. The graded absorption layer 102 may be formed such that the absorptivity of the layer corresponds with the intensity profile of the non-uniform light 501 incident on the layer 102 so that the most intense light impinges on the least absorptive portion of the layer 102.

Referring again to FIG. 1D, in one embodiment, the plasma lamp 101 may contain any selected gas (e.g., argon, xenon, mercury or the like) known in the art suitable for generating plasma upon absorption of suitable illumination. In one embodiment, focusing illumination 109 from the illumination source 111 into the volume of gas 108 causes energy to be absorbed through one or more selected absorption lines of the gas or plasma within the plasma lamp 101 (e.g., within plasma bulb, plasma cell or plasma chamber), thereby "pumping" the gas species in order to generate or sustain a plasma. In another embodiment, although not shown, the plasma lamp 101 may include a set of electrodes for initiating the plasma 106 within the internal volume of the plasma cell 101, whereby pumping radiation 109 from the illumination source 111 maintains the plasma 106 after ignition by the electrodes.

It is contemplated herein that the system 100 may be utilized to initiate and/or sustain plasma 106 in a variety of gas environments. In one embodiment, the gas used to initiate and/or maintain plasma 106 may include an inert gas (e.g., noble gas or non-noble gas) or a non-inert gas (e.g., mercury). In another embodiment, the gas 108 used to initiate and/or maintain plasma 106 may include a mixture of gases (e.g., mixture of inert gases, mixture of inert gas with non-inert gas or a mixture of non-inert gases).

It is further noted that the system 100 may be implemented with a number of gases. For example, gases suitable for implementation in the system 100 of the present disclosure may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. The system 100 of the present disclosure should be interpreted to extend to any architecture suitable for light-sustained plasma generation and should further be interpreted to extend to any type of gas suitable for sustaining a plasma within a plasma lamp The transmission element 104 (e.g., wall of the plasma bulb, wall of a plasma cell, window, etc.) of the plasma lamp 101 of system 100 may be formed from any material known in the art that is at least partially transparent to radiation generated by plasma 106. In one embodiment, the transmission element 104 of plasma lamp 101 may be formed from any material known in the art that is at least partially transparent to VUV radiation generated by plasma 106. In one embodiment, the transmission element 104 of plasma lamp 101 may be formed from any material known in the art that is at least partially transparent to DUV radiation generated by plasma 106. In another embodiment, the transmission element 104 of plasma lamp 101 may be formed from any material known in the art that is at least partially transparent to EUV light generated by plasma 106. In another embodiment, the transmission element 104 of plasma lamp 101 may be formed from any material known in the art that is at least partially transparent to UV light generated by plasma 106. In another embodiment, the transmission element 104 of plasma lamp 101 may be formed from any material known in the art that is at least partially transparent to visible light generated by plasma 106.

In another embodiment, the transmission element 104 of plasma lamp 101 may be formed from any material known in the art that is at least partially transparent to the pumping illumination 109 (e.g., IR radiation) from the illumination source 111. In another embodiment, the transmission element 104 of plasma lamp 101 may be formed from any material known in the art that is at least partially transparent to both radiation 109 from the illumination source 111 (e.g., IR source) and broadband radiation 110 (e.g., VUV radiation, DUV radiation, EUV radiation, UV radiation and/or visible radiation) emitted by the plasma 106 contained within the volume of transparent portion 102 of plasma lamp 101. In some embodiments, the transmission element 104 of plasma lamp 101 may be formed from a low-OH or high-OH content fused silica glass material. For example, the transmission element 104 of plasma lamp 101 may include, but is not limited to, SUPRASIL 1, SUPRASIL 2, SUPRASIL 300, SUPRASIL 310, HERALUX PLUS, HERALUX-VUV, and the like. In other embodiments, the transmission element 104 of plasma lamp 101 may include, but is not limited to, calcium fluoride ($CaF_2$), magnesium fluoride ($MgF_2$), lithium fluoride ($LiF_2$), crystalline quartz or sapphire. It is noted herein that materials such as, but not limited to, $CaF_2$, $MgF_2$, crystalline quartz and sapphire provide transparency to short-wavelength radiation (e.g., $\lambda<190$ nm). Various glasses suitable for implementation in the transparent portion 102 of plasma cell 101 of the present disclosure are discussed in detail in A. Schreiber et al., *Radiation Resistance of Quartz Glass for VUV Discharge Lamps*, J. Phys. D: Appl. Phys. 38 (2005), 3242-3250, which is incorporated herein by reference in the entirety.

The transmission element 104 (e.g., wall of bulb, wall of plasma cell, etc.) of the plasma lamp 101 may take on any shape known in the art. In the case where the plasma lamp 101 is a plasma cell, the transmission element 104 may have a cylindrical shape. In another embodiment, although not shown, the transmission element 104 may have a spherical or ellipsoidal shape. In another embodiment, although not shown, the transmission element 104 may have a composite shape. For example, the shape of the transmission element 104 may consist of a combination of two or more shapes. For instance, the shape of the transmission element 104 may consist of a spherical or ellipsoidal center portion, arranged to contain the plasma 106, and one or more cylindrical portions extending above and/or below the spherical or ellipsoidal center portion, whereby the one or more cylindrical portions are coupled to the one or more flanges. In the case where the transmission element 104 is cylindrically shaped, as shown in FIG. 1E, the one or more openings of the transmission element 104 may be located at the end portions of the cylindrically shaped transmission element 104. In this regard, the transmission element 104 takes the form of a hollow cylinder, whereby a channel extends from the first opening (top opening) to the second opening (bottom opening). In another embodiment, flanges at each opening of the transmission element 104 together with the transparent/semi-transparent wall(s) of the transmission element 104 serve to contain the volume of gas 108 within the channel of the transmission element 104. It is recognized herein that this arrangement may be extended to a variety of transmission element shapes, as described throughout the present disclosure.

In settings where the plasma lamp 101 is a plasma bulb, the transmission element 104 of the plasma bulb may also take on any shape known in the art. In one embodiment, the plasma bulb may have a cylindrical shape. In another embodiment, the plasma bulb may have a spherical or ellipsoidal shape. In another embodiment, the plasma bulb may have a composite shape. For example, the shape of the plasma bulb may consist of a combination of two or more shapes. For instance, the shape of the plasma bulb may consist of a spherical or ellipsoidal center portion, arranged to contain the plasma 106, and one or more cylindrical portions extending above and/or below the spherical or ellipsoidal center portion.

In another embodiment, the one or more absorptive layers 102 of the present disclosure may be formed on one or more of the curved surfaces of the transmission element 104 of the plasma lamp 101. For example, in the case of a plasma bulb or plasma cell, the one or more absorptive layers 102 may be formed on the internal surface and/or the external surface, which may both be curved in the case of the plasma bulb shapes described previously herein.

In another embodiment, the system includes one or more lamp optics. For example, as shown in FIG. 1D, the one or more lamp optics may include, but are not limited to, a collector element 105 (e.g., ellipsoidal mirror, parabolic mirror or spherical mirror) for directing and/or focusing illumination 109 from the illumination source 111 into the volume of gas 108 contained within the plasma lamp 101 to ignite and/or sustain the plasma 106. Further, the collector element 108 may also collect broadband radiation 110 emitted by the generated plasma 106 and direct the broadband radiation 110 to one or more additional optical elements (e.g., filter 123, homogenizer 125 and the like).

For example, the collector element 105 may collect at least one of VUV broadband radiation, DUV radiation, EUV radiation, UV radiation and/or visible radiation emitted by plasma 106 and direct the broadband illumination 110 to one or more downstream optical elements. In this regard, the plasma lamp 101 may deliver VUV radiation, DUV radiation, EUV radiation, UV radiation and/or visible radiation to downstream optical elements of any optical characterization system known in the art, such as, but not limited to, an inspection tool or a metrology tool. It is noted herein the plasma lamp 101 of system 100 may emit useful radiation in a variety of spectral ranges including, but not limited to, VUV radiation, DUV radiation, EUV radiation, UV radiation, and/or visible radiation.

In an alternative and/or additional embodiment, the one or more lamp optics may include a set of illumination optics for directing and/or focusing illumination 109 from the illumination source 102 into the volume of gas contained within the plasma lamp 101 to ignite and/or sustain the plasma 106. For example, the set of illumination optics may include a set of reflector elements (e.g., mirrors) configured to direct an output from the illumination source 111 to the volume of gas within the plasma lamp 101 to ignite and/or sustain the plasma 106. In addition, the one or more lamp optics may include, but are not limited to, a set of collection elements (e.g., mirrors) for collecting broadband radiation 110 emitted by the plasma 106 and directing the broadband radiation 110 to one or more additional optical elements. The use of separate illumination and collection optics in a plasma source is described generally in U.S. patent application Ser. No. 15/187,590, filed on Jun. 20, 2016, which is incorporated above by reference in the entirety.

In one embodiment, system 100 may include various additional optical elements. In one embodiment, the set of additional optics may include collection optics configured to collect broadband light emanating from the plasma 106. For instance, the system 100 may include a dichroic mirror 121 (e.g., cold mirror) arranged to direct illumination from the reflector element 105 to downstream optics, such as, but not limited to, a homogenizer 125.

In another embodiment, the set of optics may include one or more lenses (e.g., lens 117) placed along either the illumination pathway or the collection pathway of system 100. The one or more lenses may be utilized to focus illumination from the illumination source 111 into the volume of gas 108 within the plasma cell 101. Alternatively, the one or more additional lenses may be utilized to focus broadband light emanating from the plasma 106 onto a selected target (not shown).

In another embodiment, the set of optics may include a turning mirror 119. In one embodiment, the turning mirror 119 may be arranged to receive pumping illumination 107 from the illumination source 111 and direct the illumination to the volume of gas 108 contained within the plasma lamp 101 via reflector element 105. In another embodiment, the reflector element 105 is arranged to receive illumination from mirror 119 and focus the illumination to the focal point of the collection element 105 (e.g., ellipsoid-shaped reflector element), where the plasma lamp 101 is located.

In another embodiment, the set of optics may include one or more filters 123 placed along either the illumination pathway or the collection pathway in order to filter illumination prior to light entering the plasma lamp 101 or to filter illumination following emission of the light from the plasma 106. It is noted herein that the set of optics of system 100 as described above and illustrated in FIG. 1D are provided merely for illustration and should not be interpreted as a limitation on the scope of the present disclosure. It is anticipated that a number of equivalent or additional optical configurations may be utilized within the scope of the present disclosure.

In another embodiment, the illumination source 111 of system 100 may include one or more lasers. The illumination source 111 may include any laser system known in the art. For instance, the illumination source 111 may include any laser system known in the art capable of emitting radiation in the infrared, visible and/or ultraviolet portions of the electromagnetic spectrum. In one embodiment, the illumination source 111 may include a laser system configured to emit continuous wave (CW) laser radiation. For example, the illumination source 111 may include one or more CW infrared laser sources. For instance, in settings where the gas within the plasma bulb 101 is or includes argon, the illumination source 111 may include a CW laser (e.g., fiber laser or disc Yb laser) configured to emit radiation at 1069 nm. It is noted that this wavelength fits to a 1068 nm absorption line in argon and, as such, is particularly useful for pumping argon gas. It is noted herein that the above description of a CW laser is not limiting and any laser known in the art may be implemented in the context of the present invention.

In another embodiment, the illumination source 111 may include one or more modulated lasers configured to provide modulated laser light to the plasma 106. In another embodiment, the illumination source 111 may include one or more pulsed lasers configured to provide pulsed laser light to the plasma.

In another embodiment, the illumination source 111 may include one or more diode lasers. For example, the illumination source 111 may include one or more diode lasers emitting radiation at a wavelength corresponding with any one or more absorption lines of the species of the gas contained within the plasma bulb 101. In a general sense, a diode laser of the illumination source 111 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the plasma bulb 101 of system 100.

In another embodiment, the illumination source 111 may include an ion laser. For example, the illumination source 111 may include any noble gas ion laser known in the art. For instance, in the case of an argon-based plasma, the illumination source 111 used to pump argon ions may include an Ar+ laser.

In another embodiment, the illumination source 111 may include one or more frequency converted laser systems. For example, the illumination source 111 may include a Nd:YAG or Nd:YLF laser.

In another embodiment, the illumination source 111 may include one or more non-laser sources. In a general sense, the illumination source 111 may include any non-laser light source known in the art. For instance, the illumination source 111 may include any non-laser system known in the art capable of emitting radiation discretely or continuously in the infrared, visible or ultraviolet portions of the electromagnetic spectrum.

In another embodiment, the illumination source 111 may include two or more light sources. In one embodiment, the illumination source 111 may include or more lasers. For example, the illumination source 111 (or illumination sources) may include multiple diode lasers. By way of another example, the illumination source 111 may include multiple CW lasers or pulsed lasers. In a further embodiment, each of the two or more lasers may emit laser radiation tuned to a different absorption line of the gas or plasma within the plasma lamp 101 of system 100.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A laser-sustained plasma lamp comprising:

a gas containment structure configured to contain a volume of gas, the gas containment structure configured to receive pump illumination from a pump laser for generating a plasma within the volume of gas, wherein the plasma emits broadband radiation, the gas containment structure including one or more transmissive structures being at least partially transparent to at least a portion of the pump illumination from the pump laser and at least a portion of the broadband radiation emitted by the plasma, wherein the one or more transmissive structures include a predetermined graded absorption profile to control heating of the one or more transmissive structures caused by the broadband radiation emitted by the plasma to establish a selected thermal distribution of the one or more transmissive structures.

2. The plasma lamp of claim 1, wherein the predetermined graded absorption profile corresponds to the intensity profile of the broadband radiation impinging on the one or more transmissive structures.

3. The plasma lamp of claim 1, wherein the predetermined graded absorption profile includes minimum absorptivity of at least a portion of the broadband radiation at a portion of the one or more transmissive structures receiving a maximum intensity of the broadband radiation.

4. The plasma lamp of claim 1, wherein the predetermined graded absorption profile includes maximum absorptivity of at least a portion of the broadband radiation at a portion of the one or more transmissive structures receiving a minimum intensity of the broadband radiation.

5. The plasma lamp of claim 1, wherein the predetermined graded absorption profile includes a maximum absorptivity at one or more end portions of the gas containment structure and a minimum absorptivity at an equatorial portion of the gas containment structure.

6. The plasma lamp of claim 1, wherein the predetermined graded absorption profile includes a continuous change in absorptivity along one or more directions of the one or more transmissive structures.

7. The plasma lamp of claim 1, wherein the one or more transmissive structures comprise:

one or more transmission elements; and one or more graded absorption layers disposed on one or more surfaces of the one or more transmission elements, wherein the absorptivity of the one or more graded absorption layers varies as a function of position along the one or more transmission elements.

8. The plasma lamp of claim 7, wherein the one or more surfaces of the one or more transmission elements comprise:

at least one of an internal surface or an external surface.

9. The plasma lamp of claim 7, wherein the one or more predetermined graded absorption layers are formed from at least one of aluminum, carbon or hafnium.

10. The plasma lamp of claim 1, wherein the one or more transmissive structures comprise:

one or more transmission elements doped with one or more absorbing materials such that the absorptivity of the one or more transmission transparent elements is a function of position along the one or more transmission elements.

11. The plasma lamp of claim 10, wherein the one or more absorbing materials comprise at least one of aluminum, carbon or hafnium.

12. The plasma lamp of claim 10, wherein the one or more absorbing materials comprise an absorbing material for absorbing non-usable broadband radiation.

13. The plasma lamp light source of claim 1, wherein the one or more transmissive structures comprise at least one of a transparent or semi-transparent wall of a plasma bulb.

14. The plasma lamp light source of claim 1, wherein the one or more transmissive structures comprise at least one of a transparent or semi-transparent wall of a plasma cell.

15. The plasma lamplight source of claim 1, wherein the one or more transmissive structures comprise one or more windows of a plasma chamber.

16. The plasma lamplight source of claim 1, wherein the one or more transmissive structures include at least one of calcium fluoride, magnesium fluoride, lithium fluoride, crystalline quartz, sapphire or fused silica.

17. The plasma lamplight source of claim 1, wherein the gas comprises:

at least one of an inert gas, a non-inert gas and a mixture of two or more gases.

18. An optical device comprising:

an optical component including at least one of a reflective element or a transmission element; and one or more graded absorption layers disposed on one or more surfaces of at least one of the reflective element or the transmission element, wherein the one or more graded absorption layers establish a predetermined graded absorption profile to control heating of at least one of the reflective element or the transmission element caused by the broadband radiation emitted by a plasma to establish a selected thermal distribution of the one or more transmissive structures.

19. The optical device plasma lamp of claim 18, wherein the predetermined graded absorption profile corresponds to the intensity profile of the broadband radiation impinging on at least one of the reflective element or the transmission element.

20. The optical device plasma lamp of claim 18, wherein the predetermined graded absorption profile includes minimum absorptivity of at least a portion of the broadband radiation at a portion of at least one of the reflective element or the transmission element receiving a maximum intensity of the broadband radiation.

21. The optical device plasma lamp of claim 18, wherein the predetermined graded absorption profile includes maximum absorptivity of at least a portion of the broadband radiation at a portion of at least one of the reflective element or the transmission element receiving a minimum intensity of the broadband radiation.

22. The optical device plasma lamp of claim 18, wherein the predetermined graded absorption profile includes a continuous change in absorptivity along one or more directions of at least one of the reflective element or the transmission element.

23. The optical device plasma lamp of claim 22, wherein the one or more surfaces of the one or more transmission elements comprise:

at least one of an internal surface or an external surface.

24. The optical device plasma lamp of claim 18, wherein the one or more predetermined graded absorption layers is formed from at least one of aluminum, carbon or hafnium.

25. The optical device plasma lamp of claim 18, wherein the one or more absorbing materials comprises an absorbing material for absorbing non-usable broadband radiation.

26. The optical device light source of claim 18, wherein the transmission element comprises at least one of a plasma bulb, a plasma cell, a window of a plasma chamber, a lens or a beam splitter.

27. The optical device light source of claim 18, wherein the reflective element comprises at least one of mirror or a beam splitter.

28. A system for generating broadband laser-sustained plasma light comprising:

one or more pump lasers configured to generate illumination;

a plasma lamp, wherein the plasma lamp includes a gas containment structure configured to contain a volume of gas, the gas containment structure configured to receive pump illumination from a pump laser for generating a plasma within the volume of gas, wherein the plasma emits broadband radiation, the gas containment structure including one or more transmissive structures being at least partially transparent to at least a portion of the pump illumination from the pump laser and at least a portion of the broadband radiation emitted by the plasma, wherein the one or more transmissive structures include a predetermined graded absorption profile to control heating of the one or more transmissive structures caused by the broadband radiation emitted by the plasma to establish a selected thermal distribution of the one or more transmissive structures; and one or more lamp optics arranged to focus the illumination from the one or more pump lasers into the volume of gas in order to generate a plasma within the volume of gas contained within the plasma lamp.

29. The system of claim 28, wherein the one or more lamp optics are arranged to collect at least a portion of the broadband radiation emitted by the generated plasma and direct the broadband radiation to one or more additional optical elements.

30. The system of claim 28, wherein the one or more lamp optics comprise:

an ellipsoid-shaped collector element.

31. The system of claim 28, wherein the one or more pump lasers comprise:

one or more infrared lasers.

32. The system of claim 28, wherein the one or more pump lasers comprise:

a continuous wave laser.

33. The system of claim 28, wherein the one or more pump lasers comprise:

a pulsed laser.

34. The system of claim 28, wherein the one or more pump lasers comprise:

a modulated laser.

35. The system of claim 28, wherein the gas comprises:

at least one of an inert gas, a non-inert gas and a mixture of two or more gases.

* * * * *